US006027295A

United States Patent [19]

Geppert et al.

[11] Patent Number: 6,027,295

[45] Date of Patent: Feb. 22, 2000

[54] LIFTING SYSTEM FOR MANUFACTURED AND MOBILE HOMES

[75] Inventors: Carl Geppert, 26597 S. Highway 70, Canby, Oreg. 97013; Kevin L. Wood, West Linn, Oreg.

[73] Assignee: Carl Geppert, Canby, Oreg.

[21] Appl. No.: 08/828,253

[22] Filed: Mar. 26, 1997

[51] Int. Cl.[7] ..... B66F 3/00

[52] U.S. Cl. ..... 414/12; 414/427; 414/458; 414/909; 104/50; 104/128; 254/423; 254/DIG. 3; 254/DIG. 9; 280/79.11

[58] Field of Search ..... 414/909, 12, 458, 414/495, 427; 280/43, 79.11, 79.3; 104/48, 50, 127, 128; 238/13; 254/418, 425, 423, DIG. 3, DIG. 9

[56] References Cited

U.S. PATENT DOCUMENTS

| | | | |
|---|---|---|---|
| 2,472,932 | 6/1949 | Adkins | 414/12 |
| 3,587,890 | 6/1971 | Hyland | 414/12 |
| 3,817,401 | 6/1974 | Becker | 414/12 |
| 3,887,083 | 6/1975 | Baxter . | |
| 3,887,085 | 6/1975 | Baxter . | |
| 3,887,204 | 6/1975 | Austin . | |
| 3,948,400 | 4/1976 | Baxter . | |
| 3,958,705 | 5/1976 | Baxter . | |
| 3,998,340 | 12/1976 | Westwood . | |
| 4,030,699 | 6/1977 | Heimke | 414/12 |
| 4,089,271 | 5/1978 | Pack . | |
| 4,198,797 | 4/1980 | Soble . | |
| 4,200,419 | 4/1980 | Rogers . | |
| 4,352,628 | 10/1982 | Rogers . | |
| 5,012,879 | 5/1991 | Bienek et al. . | |
| 5,056,977 | 10/1991 | May | 414/12 |
| 5,100,105 | 3/1992 | Schneider et al. | 254/423 |
| 5,151,004 | 9/1992 | Johnson | 414/495 |
| 5,318,313 | 6/1994 | Chapman | 254/423 |

FOREIGN PATENT DOCUMENTS

| | | | |
|---|---|---|---|
| 759311 | 5/1967 | Canada | 414/495 |
| 1511162 | 9/1989 | Russian Federation | 414/458 |

OTHER PUBLICATIONS

Perfect–a–Line, Inc. Mobile & Modular Setting Systems Brochure (1993?).

*Primary Examiner*—Douglas Hess
*Attorney, Agent, or Firm*—Kolisch Hartwell Dickinson McCormack & Heuser

[57] ABSTRACT

A lifting system for moving mobile homes that includes wheeled jack assemblies, jack units assembled from such assemblies and a segmented track for supporting such assemblies and units. Each jack assembly preferably includes a jack rollingly carried on wheels, and a roller head operatively connected to the working end of the jack to move from a lowered position to a raised position. The wheels allow lateral adjustment of the home, while the roller head allows longitudinal adjustment of the home. In the preferred embodiment, each jack unit includes two jack assemblies, with one of the assemblies further including a drive motor operatively connected to its wheels. Furthermore, the assemblies are interconnected by a hydraulic power unit in the form of a housing that encloses and protects the hydraulics for controlling each jack and drive motor. Each segment in the segmented track generally includes a pair of rails structurally interconnected, with a hole formed adjacent each end of the segment. Segments are then connected to each other by a coupling plate that underlies the ends of the segments.

8 Claims, 8 Drawing Sheets

LIFTING SYSTEM FOR MANUFACTURED AND MOBILE HOMES

FIELD OF THE INVENTION

This invention relates generally to a system for lifting and moving manufactured and mobile homes, primarily intended for moving such homes a short distance from a point of delivery accessible by truck, to rest on a building foundation. More particularly, this invention relates to an automated lifting system in which the home is lifted by hydraulic jacks mounted on wheels, and then rolled along a segmented track to overlie the foundation, after which the home is lowered to rest on the foundation. The invention is frequently used in relatively tight and unpredictable spaces, and is designed to be assembled and disassembled with a minimum of manpower.

BACKGROUND OF THE INVENTION

Manufactured and mobile homes are produced in a factory-like setting, remote from the location where the home will ultimately be placed. Such homes often include a supporting subframe of steel I-beams that run the length of the home, upon which a frame for the home is assembled. The combination of the subframe and frame allows the home to be picked up and moved, generally from its point of manufacture, to its point of use as a home. Thus, a mobile home may be though of as a movable module. Depending on the design of the home, a single module might be all that is required for the completed home. The size of a module is normally limited by the method by which it is to be moved, so it is common to combine two or more modules to create a home larger than the largest movable module. Each module includes its own frame and subframe, and is separately movable to allow the modules to be placed next to each other as necessary, and then joined together. For example, the modular construction of a conventional home with a peak roof might be divided along the peak to create a left and right module which are separately manufactured and then abutted and fastened together at the final location for the home.

The completed modules are moved from the factory to the final location by attaching wheels to the steel I-beam subframe. Alternatively, the module may be placed on a trailer. The module is then towed by truck to its destination, where it must be attached to the ground, generally by placing the module or modules on a cement foundation. In some installations, the foundation is built so that a delivering truck can drive through the foundation, thus dragging the module to a position directly above the foundation. The wheels are then removed and the module is lowered onto the foundation with minimal effort. However, this is not workable on steeply sloped property, nor on property on which it is otherwise physically impossible to pull the truck directly through the foundation.

Accordingly, systems have been developed to lift and move home modules from a position that is accessible by truck, to a position that overlies the foundation. Examples of such systems are found in U.S. Pat. Nos. 3,887,083 and 4,352,628.

SUMMARY OF THE INVENTION

The present invention is a lifting system that includes wheeled jack assemblies, jack units assembled from such assemblies and a segmented track for supporting such assemblies and units. Each jack assembly preferably includes a jack rollingly carried on wheels, and a roller head operatively connected to the working end of the jack to move from a lowered position to a raised position. The wheels allow lateral adjustment of the home, while the roller head allows longitudinal adjustment of the home.

In the preferred embodiment, each jack unit includes two jack assemblies, with one of the assemblies further including a drive motor operatively connected to its wheels. Furthermore, the assemblies are interconnected by a hydraulic power unit in the form of a housing that encloses and protects the hydraulics for controlling each jack and drive motor. Each segment in the segmented track generally includes a pair of rails structurally interconnected, with a hole formed adjacent each end of the segment. Segments are connected to each other by a coupling plate that underlies the ends of the segments. This connection is accomplished by a pair of pins that extend upwardly from the plate with one pin extending through the hole formed at the end of one of the segments, and the other pin extending through the hole in the other segment. A levered-arm clamp can then be used to retain the ends of the segments on the pins, thereby securing an end of each segment to the adjacent segment.

Each of the above described elements relates to and complements the others, as described in more detail below.

DETAILED DESCRIPTION OF THE PREFERRED EMBODIMENT

Figure 1:
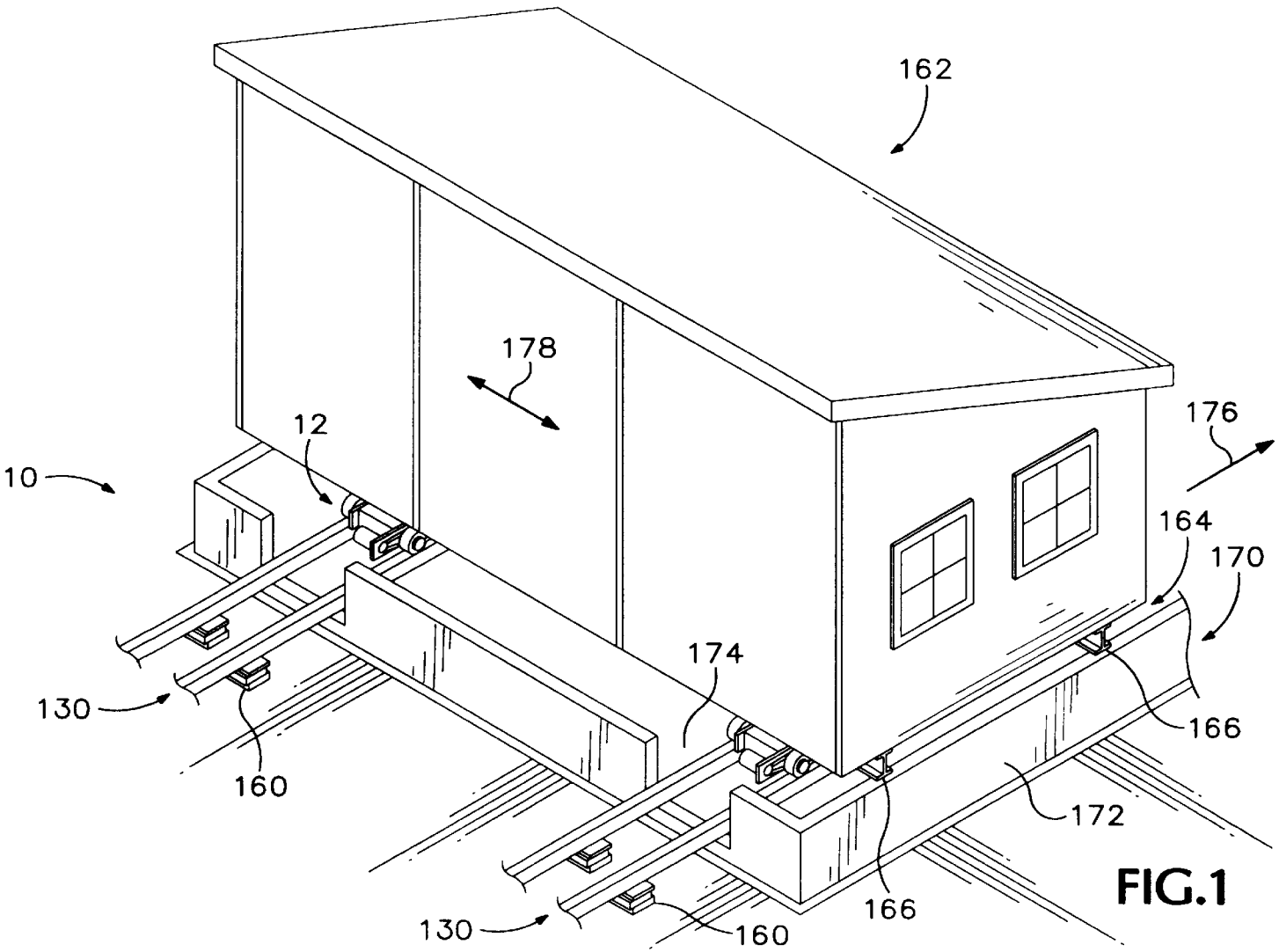
FIG. 1 is an isometric view of the system of the present invention, showing a home module being moved from its point of delivery to a building foundation.

Referring to the drawings, the hydraulic lifting system of the present invention is indicated generally at 10. As shown best in FIGS. 2 and 3, hydraulic lifting system 10 includes a jack system 12, which in turn includes one or more jack units 14. Each jack unit 14 includes at least one wheeled jack or jack assembly 16.

Figure 4:
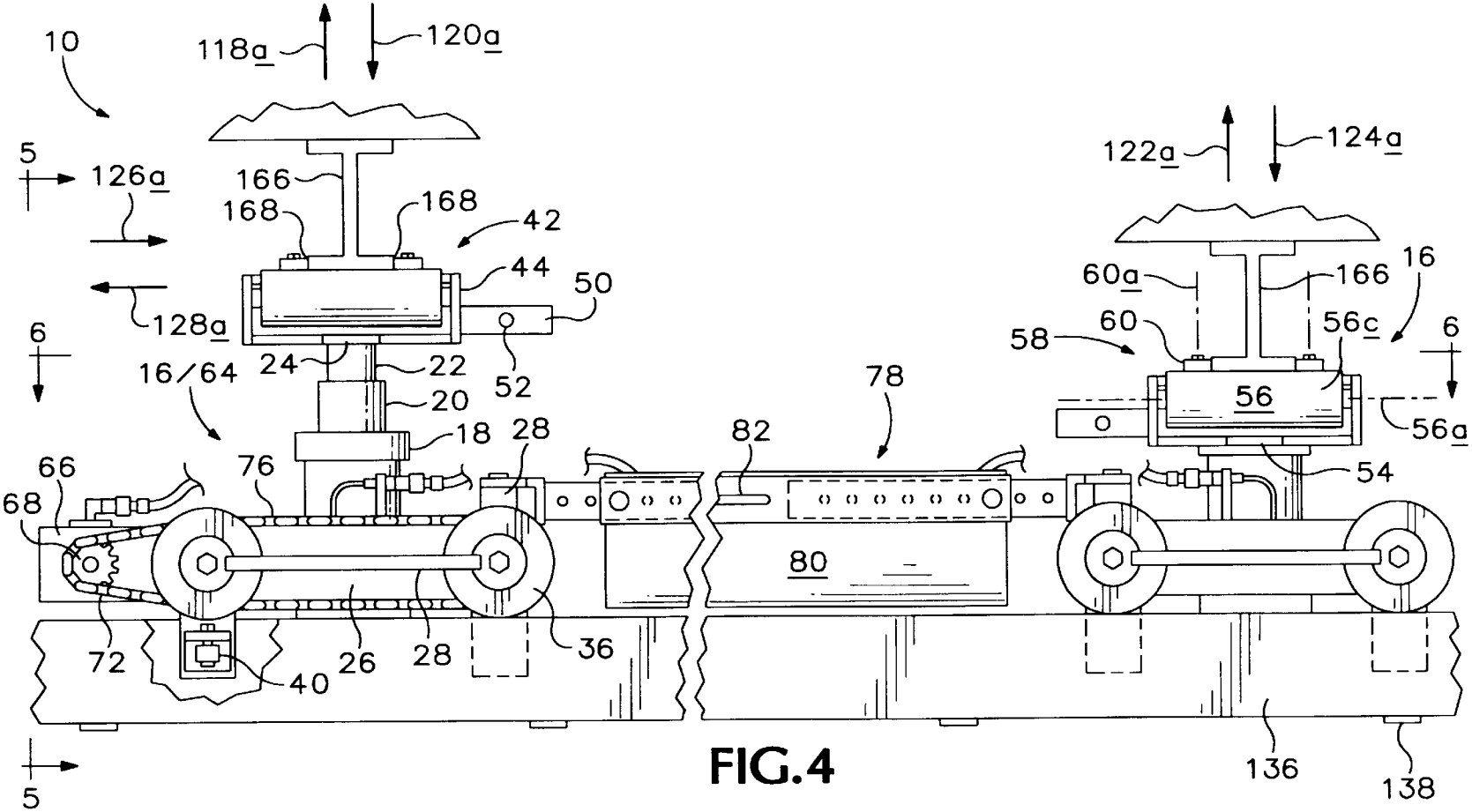
FIG. 4 is a side elevation of the jack unit as in FIG. 3, shown with portions of the segmented track removed to show detail, and shown with one jack assembly in its raised position and the other jack assembly in its lowered position.
Figure 5:
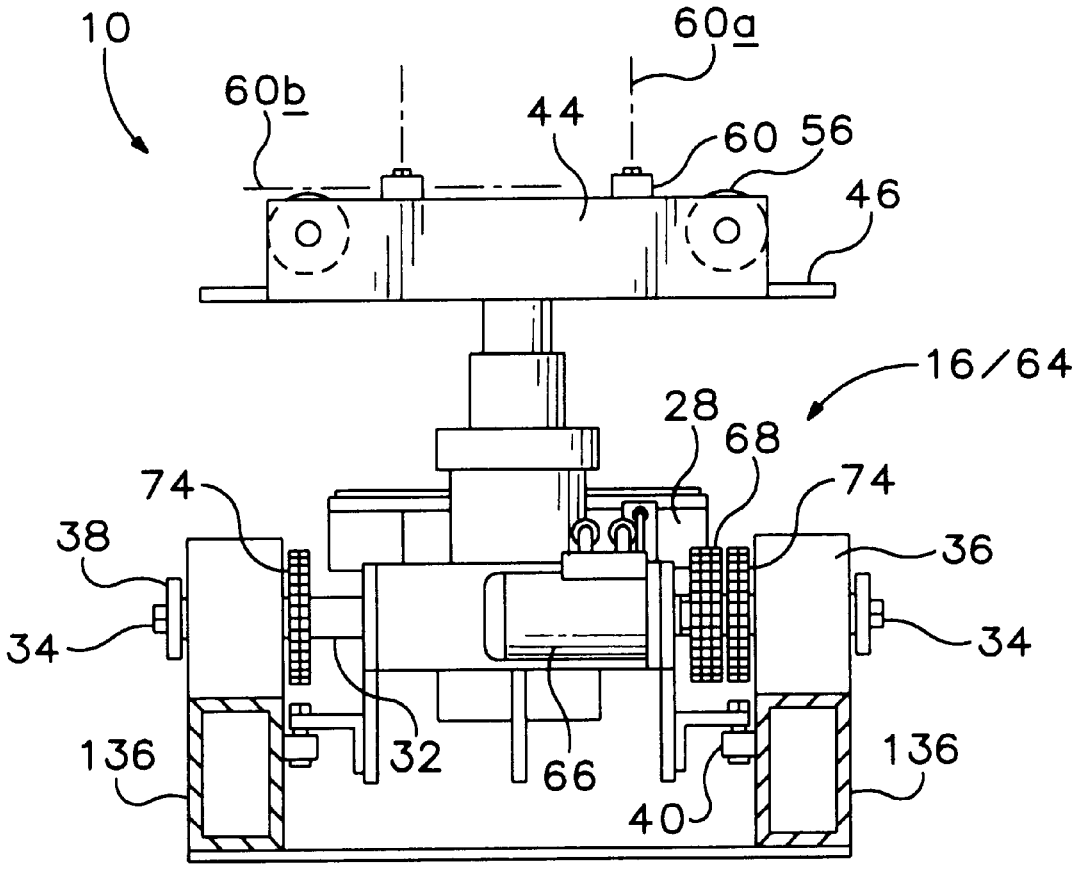
FIG. 5 is an end elevation of one of the jack assemblies in the jack unit shown in FIG. 4, taken generally along line 5—5 in FIG. 4, with the segmented track shown in cross-section.
Figure 6:
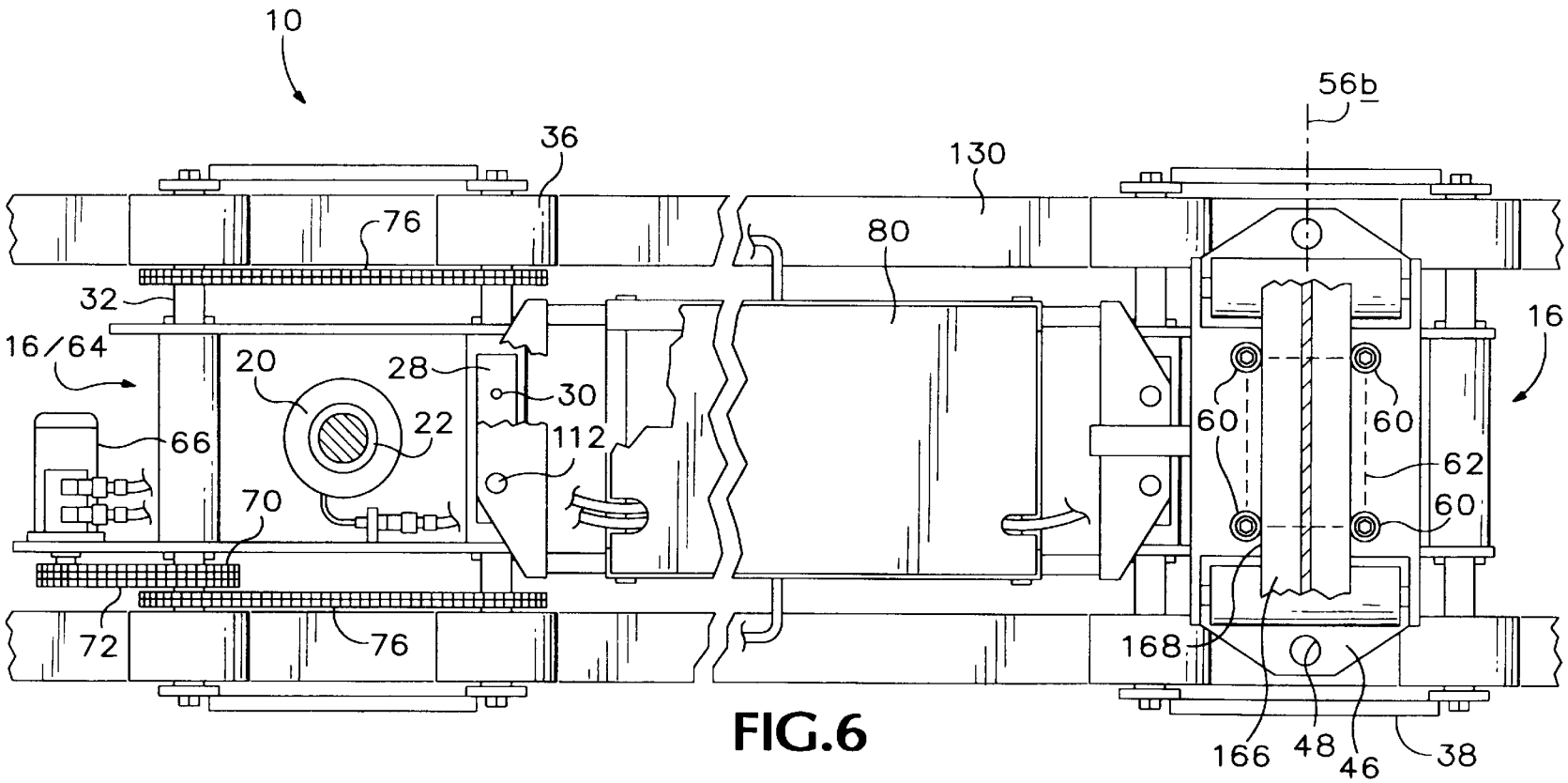
FIG. 6 is a top-detail of the jack unit shown in FIG. 4, taken generally along line 6—6 in FIG. 4.

Turning now to FIGS. 4, 5 and 6, jack assembly 16 includes a jack 18, preferably a bottle jack having at least two telescoping stages, including a lower or outer stage 20 and an upper or inner stage 22. A working end 24 and a base 26 of jack 18 are labeled in FIG. 4 for reference. Jack 18 is supported on a frame 28. Frame 28 has at least one hole 30 exposed for receiving a pin.

A pair of parallel axles 32, each having a distal end 34, are attached to frame 28. A wheel 36 is then mounted on each axle 32, and a rod 38 interconnects at least two of the distal ends to create a stiffener or handle 38. A thrust guide 40, preferably in the form of a ball or roller bearing, is attached to frame 28 so that thrust guide 40 extends below wheels 36.

Attached to working end 24 of jack 18 is a roller head 42 including a roller body 44 with outwardly extending ears 46, each ear 46 having a hole 48. A torsion bar 50 extends outwardly from body 44, and has a hole 52. Body 44 is attached to working end 24 by a swivel 54, which may be as simple as a bolt threaded into working end 24. A horizontal roller 56, having an axis of rotation 56*a*, an axis of linear movement 56*b* and a central region 56*c*, is attached to body 44.

An aligner is formed on body 44 as indicated generally at 58, and in the preferred embodiment, includes a vertical roller 60. Preferably, four vertical rollers 60 are placed on each roller head 42 to define a rectangle, as indicated generally at 62.

Each jack unit 14 generally includes one jack assembly 16, as described above, plus a self-propelled jack assembly 64. Self-propelled jack assembly 64 preferably includes all of the elements described for jack assembly 16 and further includes a drive motor 66, attached to which is a motor sprocket 68. A drive sprocket 70 is then affixed to one of the wheels 36, and driven by drive motor 66 via a drive chain 72.

Self-propelled jack assembly 64 can be provided with two-wheel drive by affixing two wheels 36 to one axle 32, and rollably attaching axle 32 to frame 28 via bearings (the axle method). Alternatively, or in addition, a wheel sprocket 74 can be affixed to each wheel 36, and pairs of wheels 36 can be interconnected by a wheel chain 76 (the wheel chain method). If both the "axle" and "wheel chain" methods of driving wheels 36 are used simultaneously, four-wheel drive is provided.

Figure 7:
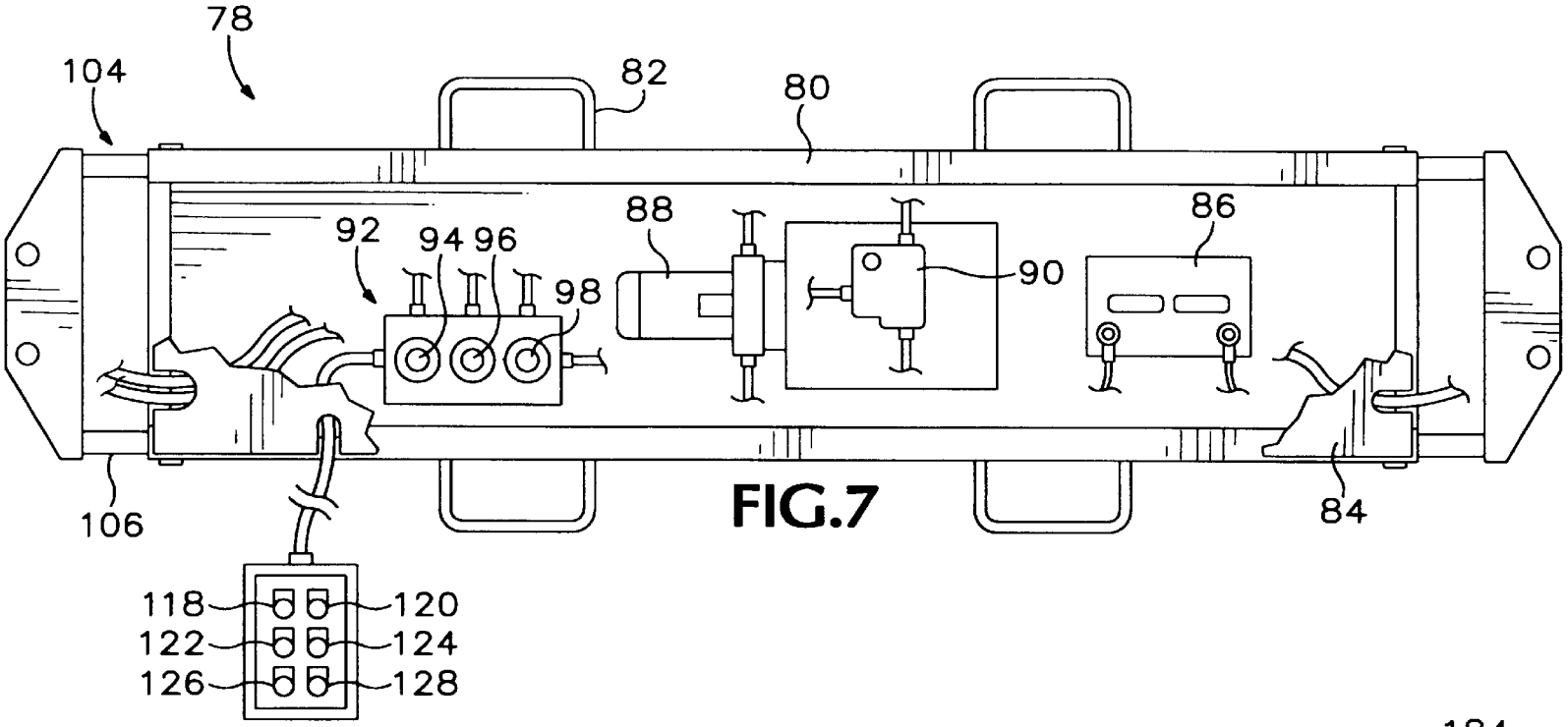
FIG. 7 is a top plan view of the hydraulic power unit of the present invention, shown with portions of the housing removed to reveal some of the elements of the hydraulic power unit.
Figure 8:
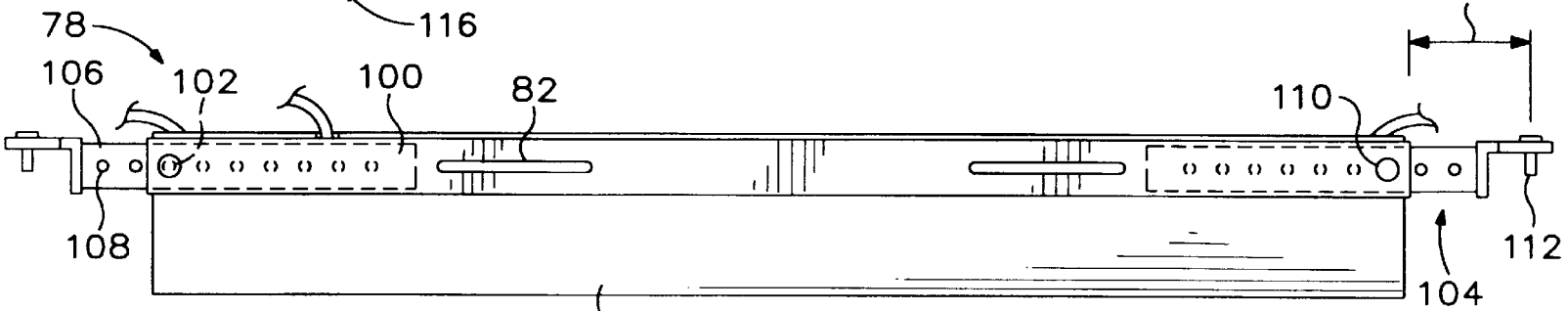
FIG. 8 is a side elevation of the hydraulic power unit shown in FIG. 7.

Each jack unit 14 preferably includes a hydraulic power unit 78, shown in detail in FIGS. 7 and 8. Hydraulic power unit 78 is formed from a structural housing or body 80 attached to which is a pair or more of handles 82 for lifting body 80. A lid 84 closes body 80, both protecting the contents of body 80 from damage, and providing a snag-free profile for moving smoothly underneath a mobile home.

Enclosed within housing 80 is a source of pressurized hydraulic fluid, including a battery 86, a pump 88 driven by battery 86, and a hydraulic manifold 90. Valves 92 are operatively connected to pump 88, and include a first vertical-control solenoid valve 94, a second vertical-control solenoid valve 96 and a horizontal-control solenoid valve 98.

Figure 2:
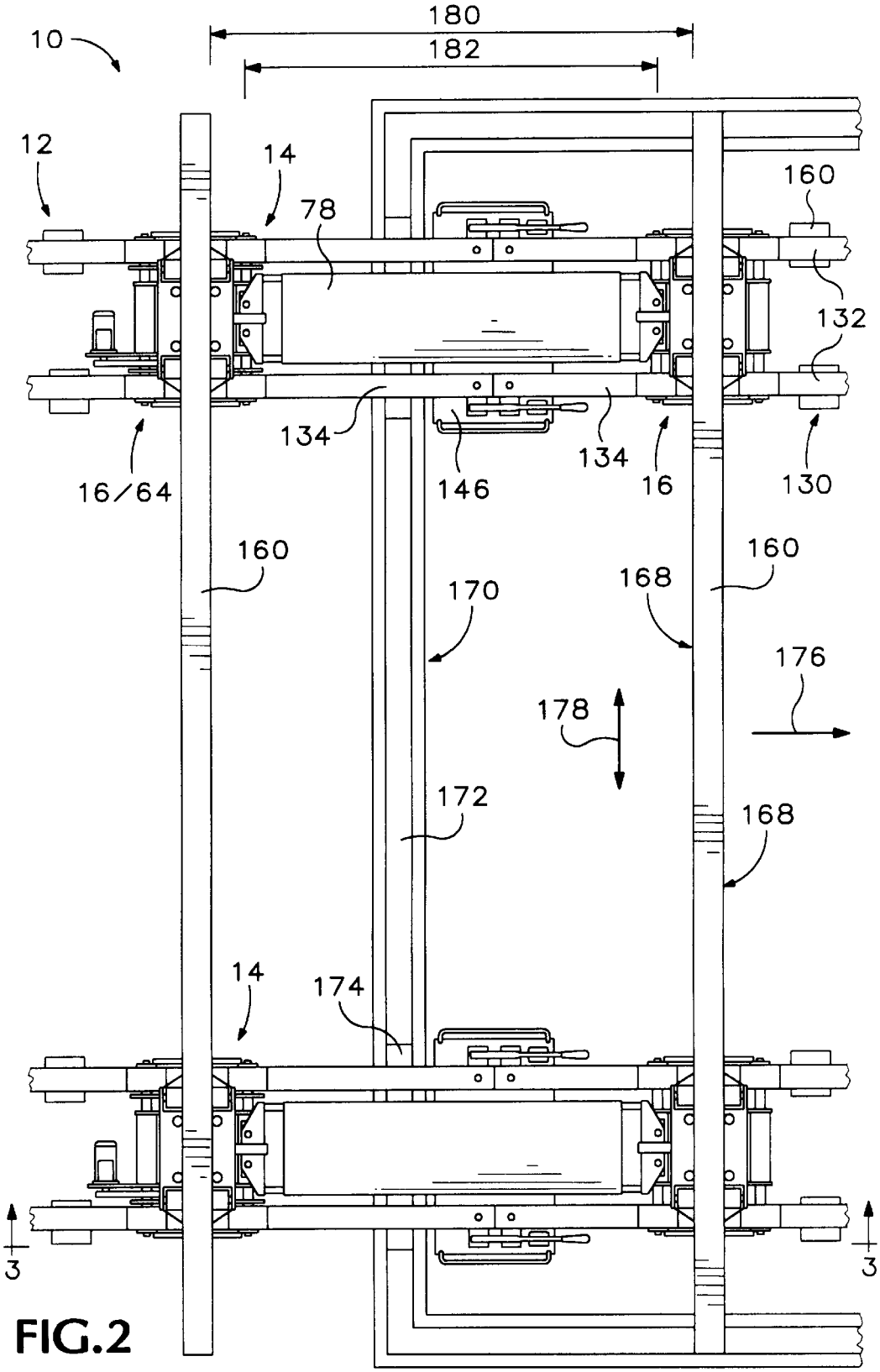
FIG. 2 is a top view of the present invention, showing the substructure of the home, a pair of jack units and a portion of the segmented track.
Figure 3:
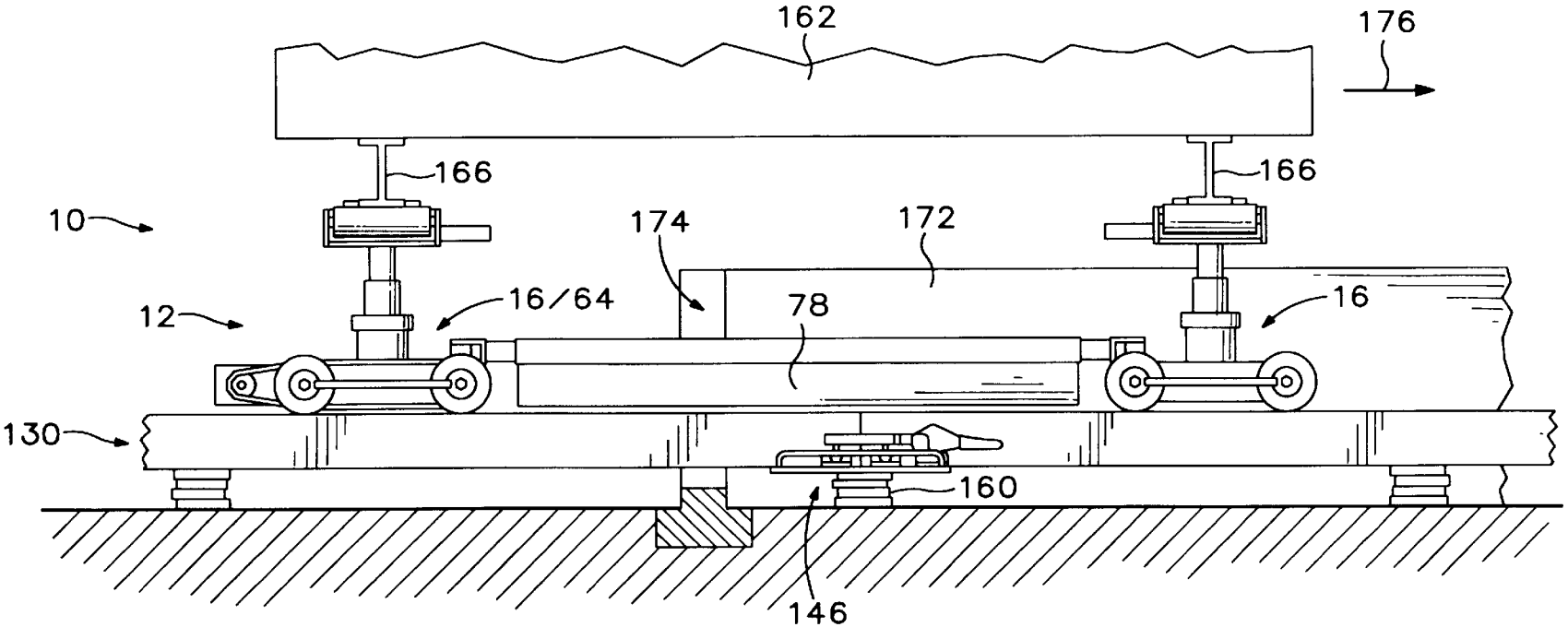
FIG. 3 is a side elevation of one of the jack units shown in FIG. 2, taken along line 3—3 in FIG. 2.

In the preferred embodiment, hydraulic power unit 78 structurally interconnects jack assemblies 16 and 64, as shown in FIGS. 2 and 3, with the distance between assemblies 16 and 64 being adjustable. Returning to FIGS. 7 and 8, a sleeve 100 having a hole 102 extendably receives an extension or support beam 104. Preferably, support beam 104 includes parallel beams 106 each having multiple spaced holes 108. A lock in the form of a removable pin 110 can then be inserted into hole 102 and a selected one of holes 108 to lock support beam 104 to body 80. Downwardly protruding pins 112 are operatively connected to support beam 104, with each such pin 112 cooperating with one of holes 30 in frame 28 of either jack assembly 16 or jack assembly 64 to form a toolless, manually-releasable coupling.

Jack system 12 is controlled by a control assembly 116, also referred to as remote controller or switch assembly 116. In the preferred embodiment, there is one such remote controller for each jack unit 14, although it would be possible to have a single remote controller 116 attached to multiple such jack units 14 in a given jack system 12.

Each remote controller 116 includes multiple switches, as labeled in FIG. 7, with the item number for each switch being associated with a direction of movement as indicated in FIG. 4 by the same item number followed by an "*a*". For reference, these switches are referred to as a first upward vertical-control 118, a first downward vertical-control 120, a second upward vertical-control 122, a second downward vertical-control 124, a forward horizontal-control 126 and backward horizontal-control 128. Preferably, a hydraulic ramping control is integrated into controller 116, allowing for smooth starting and stopping of each jack system 12. One such control is available from CPM Group, 4120 SE International Way, Suite 107, Milwaukee, Oreg. 97222, 503-794-0708.

Figure 9:
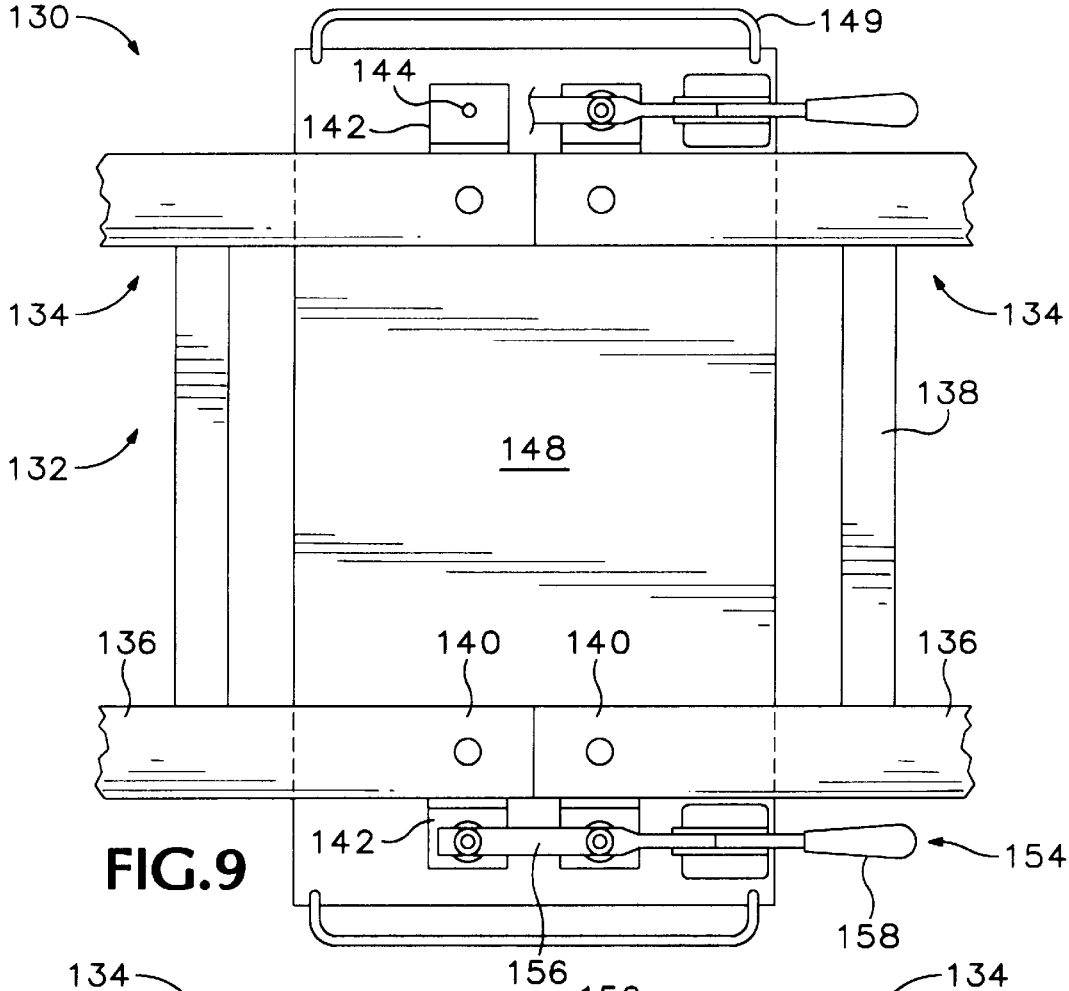
FIG. 9 is a top plan view of the segmented track shown in FIG. 2, showing the ends of two abutting segments, and the plate and clamp assembly that couples the segments together.
Figure 10:
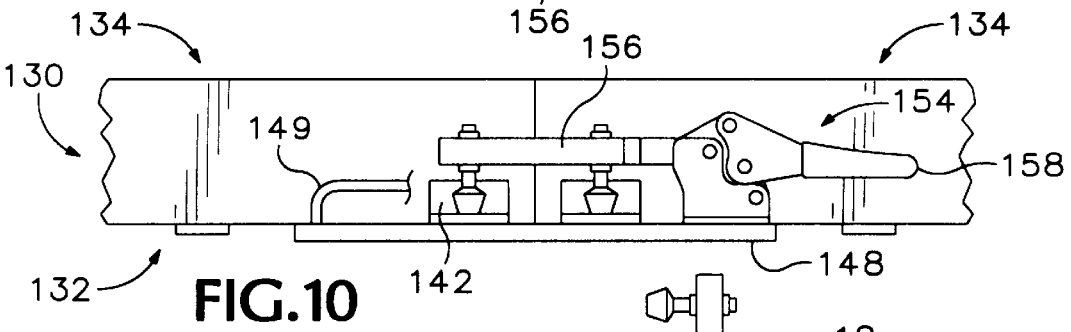
FIG. 10 is a side elevation of the portion of segmented track shown in FIG. 9, shown with portions of the plate removed to show detail.
Figure 11:
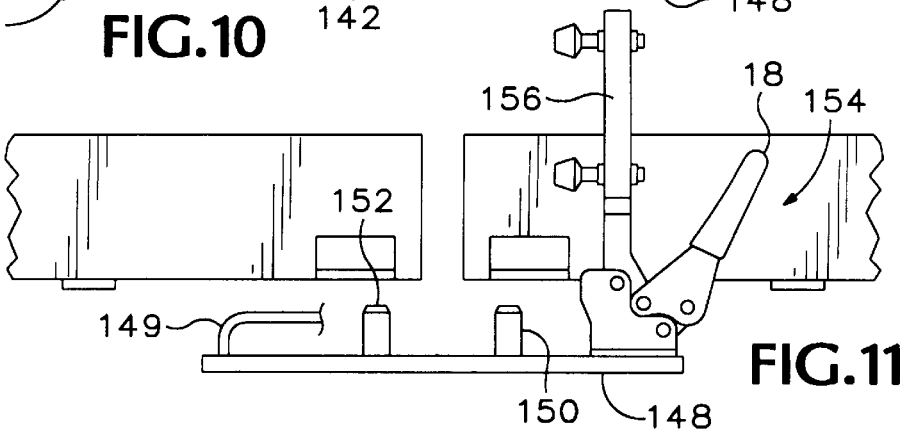
FIG. 11 is a side view of the portion of segmented track shown in FIG. 10, shown with the segments separated from the coupling plate.

Lifting system 10 also includes a track assembly 130, shown generally in FIGS. 2 and 3, preferably including parallel segmented tracks 132. Turning now to FIGS. 9–11, each such track 132 is made up of separable pairs of segments 134, formed from rails 136 interconnected by a tab 138. Each segment 134 includes ends indicated at 140, with protrusions 142 extending outwardly from rails 136 adjacent each end 140. A hole 144 is formed in each protrusion 142.

Adjacent pairs of segments 134 are connected by segment connectors 146 including a plate 148 with one or more handles 149 and one or more pins 150 extending upwardly from plate 148 to define an upper end 152. A lever-arm clamp 154 having a lever 156 operated by a handle 158 is attached to plate 148 so that, when actuated, lever 156 clamps upper end 152 of each of pins 150. Tracks 132 can be leveled with shims 160.

For reference, a house 162 is shown in FIG. 1, and can also be referred to as a mobile home, manufactured home, portable structure or completed module. Each module 162 generally includes a subframe 164 including a pair of I-beams 166 defining one or more vertical surfaces 168, shown in FIG. 4. A foundation 170, seen best in FIGS. 1–3, has vertical walls 172 with apertures 174 formed therein for receiving lifting system 10. The direction of movement of module 162 from its point of delivery to its destination point on foundation 170 is indicated by arrow 176, and a secondary direction of movement referred to as house side-shift as indicated by arrows 178.

The distance between I-beams 166 is indicated in FIG. 2 by dimensional arrow 180. The distance between jack assemblies 16 and 64 is indicated by dimensional arrow 182, and the extension of support beam 104 is indicated in FIG. 8 by dimensional arrow 184.

Given the above identification of the various elements of lifting system 10, numerous combinations and subcombinations of these elements are within the scope of this invention. Thus, this invention can be described in many ways. For example, it includes a jack unit 14 for use in lifting a mobile home 162 comprising a jack 18, wheels 36 operatively connected to jack 18 for rollingly carrying jack 18, and a hydraulic power unit 78 for powering jack 18. Hydraulic power unit 78 provides pressurized hydraulic fluid, and includes valves 92 for controlling the operation of jack 18. A remote controller controls the operation of valves 92, and includes a switch assembly 116 remote from hydraulic power unit 78.

Jack unit 14 can further comprise a roller head 42 operatively connected to jack 18, roller head 42 including a horizontal roller 56 exposed for rollably supporting mobile home 162, and an aligner 58 for keeping roller head 42 aligned with the mobile home 162. It can also include a drive motor 66 operatively connected to wheels 36 by a chain 76 and sprocket 74 for causing wheels 36 to roll, thereby propelling jack unit 14.

Preferably, jack 18 has plural telescoping stages 20 and 22.

Jack unit 14 can also comprise a toolless, releasable coupling for connecting the hydraulic power unit 78 to the jack 18, such as the combination of pin 112, operatively connected to and downwardly extending from hydraulic power unit 78, and hole 30 operatively connected to the jack 18, with hydraulic power unit 78 being connected to jack 18 by inserting pin 112 into hole 30.

In one embodiment of the invention, jack unit 14 comprises a pair of parallel axles 32 extending outwardly from a jack 18, each axle 32 terminating in a distal end 34, and a rod 38 interconnecting distal ends 34 of axle 32 to create a handle 38 for carrying jack 18. Preferably, one of wheels 36 is mounted on one of axles 32, and another of wheels 36 is mounted on another of axles 32.

The invention can also be described as a jack unit 14 for use in a hydraulic lifting system 10 for lifting mobile homes 162, comprising a self-propelled jack assembly 64 including a jack 18, wheels 36 operatively connected to jack 18 for rollingly carrying jack 18, and a drive motor 66 operatively connected to wheels 36 for causing wheels 36 to roll, thereby propelling jack unit 14. An auxiliary jack assembly 16 can then be operatively connected to self-propelled jack assembly 64, the auxiliary jack assembly 16 including a jack 18 and wheels 36 operatively connected to jack 18 for rollingly carrying jack 18. Preferably, this embodiment further includes a hydraulic power unit 78 operatively connected to self-propelled jack assembly 64 so that hydraulic power unit 78 moves with self-propelled jack assembly 64, and hydraulic power unit 78 interconnects self-propelled jack assembly 64 to the auxiliary jack assembly 16. In at least one such embodiment, jack unit 14 further comprises an extendable support beam 104 extending outwardly from hydraulic power unit 78, so that the distance between self-propelled jack assembly 64 and auxiliary jack assembly 16 can be adjusted by adjusting the extension of support beam 104.

Described still differently, the invention is a jack assembly 16 for use in a hydraulic lifting system 10 for lifting mobile homes 162, comprising a jack having a working end 24 and a base 26, working end 24 moving relative to base 26. A roller head 42 is then operatively connected to working end 24, roller head 42 including a horizontal roller 56 exposed for rollably supporting a mobile home 162, and an aligner 58 for keeping roller head 42 aligned with mobile home 162. Aligner 58 preferably includes a vertical roller 60 exposed for rollably engaging a vertical surface 168 of mobile home 162, thereby keeping roller head 42 aligned one or more vertical surfaces 168.

Furthermore, the horizontal roller 56 preferably has an axis of rotation 56*a*, an axis of linear movement 56*b* about perpendicular to axis of rotation 56*a* and a central region 56*c* about centered along axis of linear movement 56*b*. In this embodiment aligner 58 includes a pair of vertical rollers 60 operatively connected to roller head 42 so that axis of linear movement 60*b* extends between pair of vertical rollers 60. Two pairs of vertical rollers 60 could also be operatively connected to roller head 42 to define a rectangle 62 with one vertical roller 60 located at each comer of the rectangle, each pair of vertical rollers 60 being oriented relative to horizontal roller 56 so that axis of linear movement 56*b* extends between vertical rollers 60 of each pair.

Each of the above embodiments can be combined with a segmented track 132 comprising a pair of segments of track 134, each segment 134 having an end 140 with a hole 144 formed adjacent end 140. A plate 148 underlies each defined end 140, and includes a pair of pins 150 operatively connected to and extending upwardly from plate 148 to each define an upper end 152, and a levered-arm clamp 154 attached to plate 148 so that clamp 154 closes off ends 152 of both pins 150. A defined end 140 of one segment 134 is then connected to a defined end 140 of another segment 134 by placing hole 144 of defined end 140 of one segment 134 over one pin 150 and placing defined end 140 of the other segment 134 over the other pin 150. Clamp 154 is then closed to retain each segment 134 on its respective pin 150.

Modifications to the preferred embodiment can be made without departing from the scope of the present invention. These modifications are intended to be encompassed by the following claims.

We claim:

1. A system for use in lifting mobile homes, comprising:

a jack;

at least two wheels operatively connected to the jack for rollingly carrying the jack;

a hydraulic power unit for providing pressurized hydraulic fluid to the jack, the hydraulic power unit including valves for controlling the operation of the jack;

a remote controller for controlling the operation of the valves, the controller including a switch assembly remote from the hydraulic power unit;

a pair of parallel axles extending outwardly from the jack, each axle terminating in a distal end; and a rod interconnecting the distal ends of the axle to create a handle for carrying the jack;

wherein at least one of the wheels is mounted on one of the axles, and another of the wheels is mounted on another of the axles.

2. A system for use in a hydraulic lifting system for lifting a mobile home, comprising:

a self-propelled jack assembly including a first jack, wheels operatively connected to the first jack for rollingly carrying the first jack and a drive motor operatively connected to the wheels for causing the wheels to roll, thereby propelling the self-propelled jack assembly;

an auxiliary jack assembly operatively connected to the self-propelled jack assembly, the auxiliary jack assembly including a second jack and wheels operatively connected to the second jack for rollingly carrying the second jack; and a hydraulic power unit for providing pressurized hydraulic fluid to each of the first jack and the second jack, the hydraulic power unit being operatively connected to the self-propelled jack assembly so that the hydraulic power unit moves with the self-propelled jack assembly;

wherein the hydraulic power unit interconnects the self-propelled jack assembly to the auxiliary jack assembly.

3. The system according to claim 2, further comprising a toolless, releasable coupling for connecting the hydraulic power unit to one of the jack assemblies.

4. The system according to claim 2, further comprising an extendable support beam extending outwardly from the hydraulic power unit, so that the distance between the self-propelled jack assembly and the auxiliary jack assembly can be adjusted by adjusting the extension of the support beam.

5. A system for use in a hydraulic lifting system for lifting a mobile home, comprising:

a self-propelled jack assembly including a first jack, wheels operatively connected to the first jack for rollingly carrying the first jack and a drive motor operatively connected to the wheels for causing the wheels to roll, thereby propelling the self-propelled jack assembly;

an auxiliary jack assembly operatively connected to the self-propelled jack assembly, the auxiliary jack assembly including a second jack and wheels operatively connected to the second jack for rollingly carrying the second jack;

a hydraulic power unit for providing pressurized hydraulic fluid to each of the first jack and the second jack, the hydraulic power unit being operatively connected to the self-propelled jack assembly so that the hydraulic power unit moves with the self-propelled jack assembly;

a pair of parallel axles extending outwardly from one of the jacks, each axle terminating in a distal end; and a rod interconnecting the distal ends of the axle to create a handle for carrying the jack;

wherein one of the wheels is mounted on one of the axles, and another of the wheels is mounted on another of the axles.

6. A lifting system for lifting mobile homes, comprising:

a jack having a working end and a base, the working end moving relative to the base;

wheels operatively connected to the jack for rollingly carrying the jack; and a roller head operatively connected to the working end of the jack, the roller head including a horizontal roller exposed for rollably supporting a mobile home, and an aligner for keeping the roller head aligned with the mobile home;

wherein the aligner includes a vertical roller exposed for rollably engaging a vertical surface of the mobile home, thereby keeping the roller head aligned with the vertical surface of the mobile home.

7. The system according to claim 6, wherein:

the horizontal roller has an axis of rotation, an axis of linear movement about perpendicular to the axis of rotation and a central region about centered along the axis of linear movement; and the aligner includes a pair of vertical rollers operatively connected to the roller head so that the axis of linear movement extends between the pair of vertical rollers, each vertical roller being exposed for rollably engaging a vertical surface of the mobile home, thereby keeping the roller head aligned with one or more vertical surfaces of the mobile home.

8. The system according to claim 6, wherein:

the horizontal roller has an axis of rotation, an axis of linear movement about perpendicular to the axis of rotation and a central region about centered along the axis of linear movement; and the aligner includes two pairs of vertical rollers operatively connected to the roller head to define a rectangle with one vertical roller located at each corner of the rectangle, each pair of vertical rollers being oriented relative to the horizontal roller so that the axis of linear movement extends between the vertical rollers of each pair and each vertical roller being exposed for rollably engaging a vertical surface of the mobile home, thereby keeping the roller head aligned with one or more vertical surfaces of the mobile home.

* * * * *